US005481995A

United States Patent [19]

Hiratsuka et al.

[11] Patent Number: 5,481,995

[45] Date of Patent: Jan. 9, 1996

[54] BAR TACKING STITCH PATTERN

[75] Inventors: Katsuo Hiratsuka, Haga; Masanori Ayuta; Koichi Nakayama, both of Tochigi, all of Japan

[73] Assignee: The Singer Company N.V., Curaco, Netherlands

[21] Appl. No.: 175,446

[22] Filed: Dec. 30, 1993

[30] Foreign Application Priority Data

Jul. 22, 1993 [JP] Japan ..... 5-044366 U

[51] Int. Cl.[6] ..... A41F 1/02; D05B 3/06

[52] U.S. Cl. ..... 112/437

[58] Field of Search ..... 112/431, 437, 112/446, 447, 448, 449, 65, 66, 70, 71, 264.1, 475.25

[56] References Cited

U.S. PATENT DOCUMENTS 2,186,228 1/1940 Avis ..... 112/70

4,188,900 2/1980 Garron ..... 112/264.1

4,502,401 3/1985 Asai et al. ..... 112/264.1 X

*Primary Examiner*—Peter Nerbun

*Attorney, Agent, or Firm*—McCormick, Paulding & Huber

[57] ABSTRACT

In a bar tacking stitch pattern comprising lateral stitches formed in a sewn product in such a way as to cover the starting and ending portions of overedge chain stitches which are formed on the periphery of a button hole in the direction substantially at right angles to the extending direction thereof and zigzag stitches which cross the lateral stitches, a pair of stitches of the zigzag stitches are formed on both sides of an end portion of the button hole adjacent thereto in such a way as to be substantially symmetrical with regard to the button hole and a pair of stitches of the lateral stitches are formed on both sides of the end portion of the buttonhole adjacent thereto outside the area between a pair of line segments which respectively extends through the pair of stitches of the zigzag stitches in the extending direction of the button hole. As a result, stitches of lateral stitches are not formed in the portion of the sewn product adjacent to the buttonhole which is in a weak condition so that it is possible to form a stable and uniform bar tacking stitch pattern so as to improve the quality of the sewn product.

1 Claim, 2 Drawing Sheets

BAR TACKING STITCH PATTERN

BACKGROUND OF THE INVENTION

1. Field of the Invention

The present invention relates to a pattern of a bar tacking stitches.

2. Description and Problems of the Related Art

A lockstitch bar tacking sewing machine performs a cycle of sewing operation to form a given number of stitches for lockstitch sewing, button sewing, etc., and a bar tacking stitch pattern is formed using the lockstitch bar tacking sewing machine. Conventionally for buttonholing, bar tacking is applied to the starting and ending portions of overedge chain stitches using a sewing machine of this kind after the same are formed around a buttonhole. The bar tacking stitch pattern D is formed by performing 1.5 cycles of reciprocation of lateral sewing, i.e., forming three lateral stitches D1 as illustrated in FIG. 5, and thereafter forming zigzag stitches D2 from right to left over the lateral stitches D1, each segment of the zigzag stitches D2 extending almost vertically. In forming these lateral stitches D1, double or triple stitches 2, 4, etc. are formed about the central portion of the stitch pattern. In FIG. 5, denoted at 1 to 28 are stitches.

A conventional lockstitch bar tacking sewing machine applies such a bar tacking stitch pattern D to overedge chain stitches formed around a buttonhole C made by a cutter in the process of forming the overedge chain stitches during the holing operation, and creates a technical problem. Double or triple stitches 2, 4, etc. are formed adjacent to the center of the sewing pattern, i.e., where the sewn product 29 does not exist, in forming the lateral stitches D1 so that shrunk portions are formed in a sewn product 29 due to the tension of the sewing thread. Consequently the zigzag stitches D2 which is thereafter formed from right to left over the lateral stitches D1, becomes uneven due to the shrinkage of the sewn product 29 to make the stitch pattern irregular. Although the above problem of the irregular stitch pattern does not take place if the bar tacking stitch pattern D is formed sufficiently apart from the end portion of the buttonhole C in the extending direction thereof so as to prevent the stitch pattern D from being influenced by the slit of the buttonhole C, it is impossible to form a decent buttonholing stitch pattern including the bar tacking stitch pattern D at the end portion of the buttonhole C.

Although the slit of the buttonhole C is closed when the bar tacking stitch pattern D is formed by such a lockstitch bar tacking sewing machine, it does not settle the above technical problem. The closing operation of the slit of the buttonhole C is performed employing a work holder equipped with clamp feet and a feed plate for clamping the sewn product therebetween, wherein the right and left clamp feet which are positioned a little apart from each other press down the sewn product and thereafter are brought close to each other.

SUMMARY OF THE INVENTION

The present invention provides a bar tacking stitch pattern A comprising lateral stitches A1 formed in a sewn product 29 in which overedge chain stitches B are formed on the periphery of a buttonhole C in the direction substantially at right angles to the extending direction thereof in such a way as to cover the starting and ending portions of the overedge chain stitches B and zigzag stitches A2 which crosses the lateral stitches A1, characterized in that a pair of stitches 17 and 18 of the zigzag stitches A2 which are formed on both sides of an end portion of the buttonhole C adjacent thereto in such a way as to be substantially symmetrical with regard to the buttonhole C and the stitches 2 and 3 of the lateral stitches A1 are respectively formed on both sides of the end portion of the buttonhole C adjacent thereto outside the area between line segments L—L and M—M which extends through the stitches 17 and 18 respectively in the extending direction of the buttonhole C.

When the bar tacking stitch pattern A is formed after forming the overedge chain stitches B in this way, stitches 1 to 8 are not formed in the portion of the sewn product 29 adjacent to the buttonhole C which is in a weak condition in forming the lateral stitches A1 since the stitches 1–8 are not formed at all adjacent to the center of the overedge chain stitches B. Accordingly, the sewn product 29 can be prevented from being drawn laterally due to the stitches 1–8 of the lateral stitches A1 and from generating ugly shrinkage adjacent to the button hole C thereof. Thereafter zigzag stitches A2, each segment of which extends almost vertically, are formed over the lateral stitches A1 guided thereby so as to press down the same. As a result, the threads of the lateral stitches A1 are effectively prevented from floating and consequently from deteriorating the quality of the sewn product in spite of the omission of the stitches 1 to 8 of the lateral stitches A1 around the buttonhole C.

PREFERRED EMBODIMENT OF THE INVENTION

An embodiment of the present invention will be described hereinafter.

Figure 2:
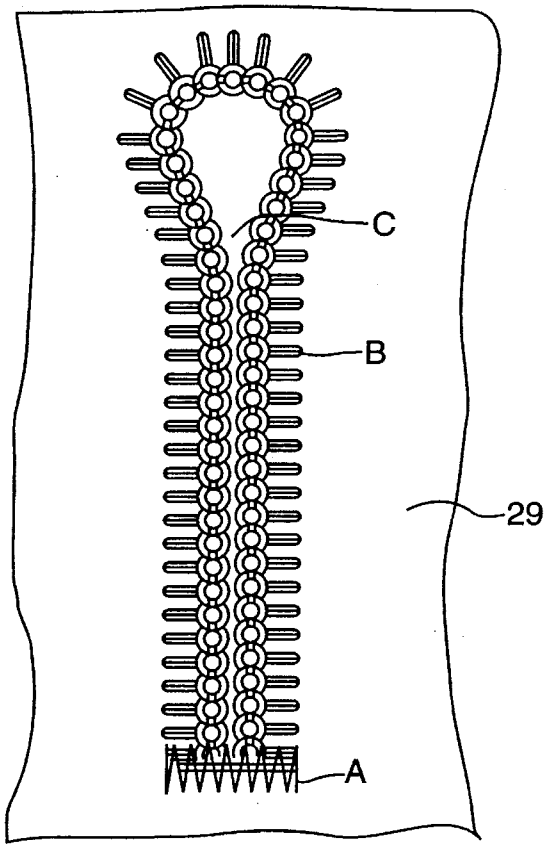
FIG. 2 is a view showing a buttonhole which has been subjected to holing according to the embodiment of the present invention.
Figure 3:
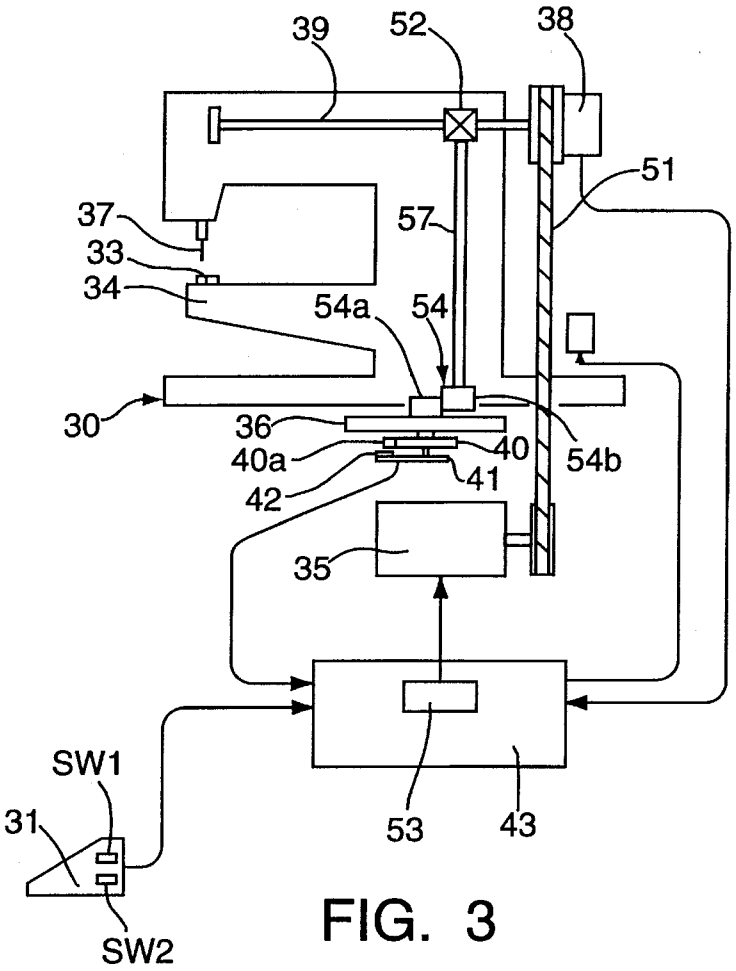
FIG. 3 is a view showing the schematic structure of a lockstitch bar tacking sewing machine according to the embodiment of the present invention.

FIGS. 1 to 4 show an embodiment of the present invention. The schematic structure of a lockstitch bar tacking sewing machine will be described hereinafter at first. In FIG. 3, denoted at 30 is a sewing machine body and a needle position detector 38 including a tachometer generator (generator type speedometer) is provided on an end portion of an arm shaft 39 rotatably supported by the sewing machine body 30 for detecting the angle of revolution of the arm shaft 39 so as to detect the position of the needle 37 driven by the arm shaft 39, the needle position detector 38 successively producing signals representing not only the needle-up position signal Nu and the needle-down position signal Nd but the number of stitches.

In FIG. 3, denoted at 43 is a control box containing a microcomputer therein which receives a step detecting signal corresponding to the stepping amount of a foot switch 31, a detecting signal produced by the needle position detector 38, a speed switching signal produced by a stop sensor 42 and a thread trimming signal and produces a signal for controlling the speed of a driving motor 35 or a thread trimming device, not shown based on these input signals.

The driving motor 35 for driving the arm shaft 39 by way of a belt transmission system 51 is composed of a servomotor which is excellent in starting and stopping characteristics and inching characteristics for applying inching thereto and easily controllable in rotating speed. The foot switch 31 comprises a first and a second switches SW1 and SW2 which operate in accordance with the stepping amount thereof, wherein for example the first switch SW1 produces a signal when it is turned OFF, while the second switch SW2 produces a signal when it is turned ON.

Denoted at 40 is a disc-shaped detecting member, which is coaxially fixed to a feed cam gear 54*a* together with a feed cam 36 and is rotated at a given reduction gear ratio by the arm shaft 39 by way of a pair of first and second gear systems 52 and 54 and a cain driving shaft 57. The cam driving shaft 57 is rotatably supported by the sewing machine body 30. The first gear system 52 is composed of a worm fixed to the arm shaft 39 and a worm wheel fixed to the cam driving shaft 57. The second gear system 54 is composed of a cam driving gear 54*b* and a feed cam gear 54*a* which engages the cam driving gear 54*b*, the cam driving gear 54*b* being fixed to the lower end portion of the cam driving shaft 57 while the feed cam gear 54*a* being rotatably supported by the sewing machine body 30 by way of a supporting shaft, not shown. As a result, both of the detecting member 40 and the feed cam 36 are also rotatably supported by the serving machine body 30.

Moreover, a stop sensor 42 is mounted on a bracket 41 which is fixed on the sewing machine body 30 in such a way as to be unrotatable. The sewing machine comprises at least one stop sensor 42. The feed cam 36 has a function to apply a given stitche pattern of a given number of stitches to the sewn product 29 in cooperation with a work holder 33 on a sewing machine bed 34 and makes one revolution in a cycle of sewing operation.

Figure 4:
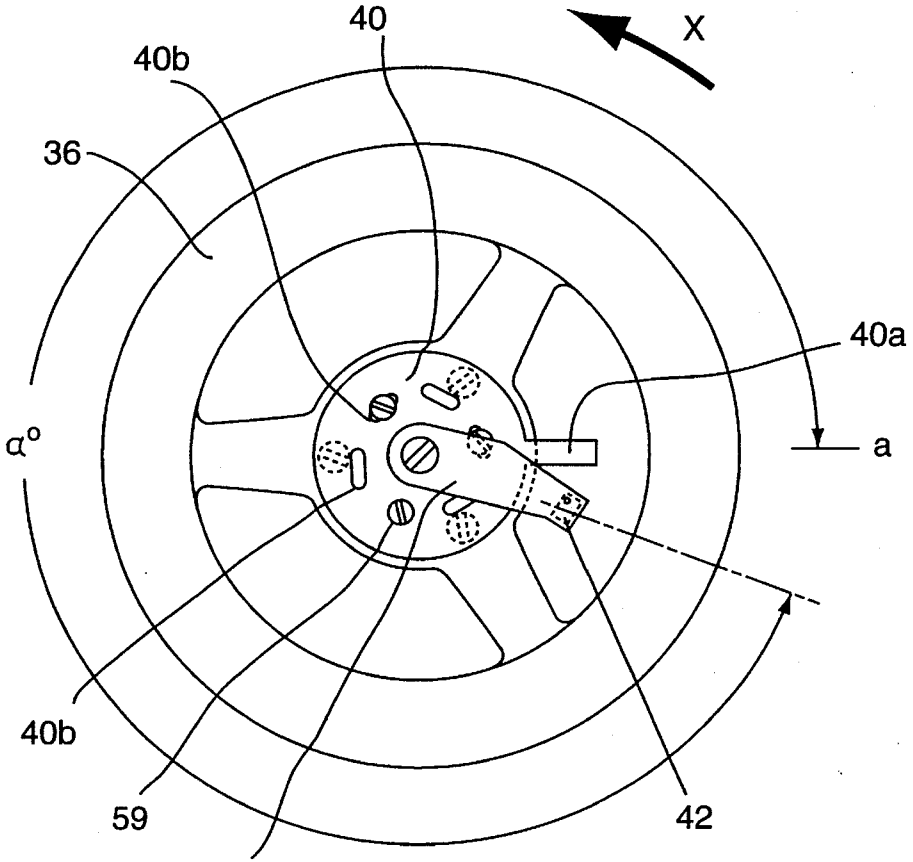
FIG. 4 is a view showing a feed cam in FIG. 3.

The detecting member 40 having a shape of disc as illustrated in FIG. 4 comprises a tongue 40*a* serving as a detector radially projecting at a part of the outer circumference thereof and is adjustable in circumferential mounting position on the feed cam gear 54*a*. More in detail, set screws 59 are screwed into the feed cam gear 54*a* through a plurality of long holes 40*b* arranged circumferentially at a given interval in the detecting member 40 and mounting holes formed in the feed cam 36. It is possible to continuously adjust the circumferential position of the detecting member 40 on the feed cam gear 54*a* by changing the fastening position of the set screws 59 in the long holes 40*b*.

The feed cam 36 and the detecting member 40 are driven to rotate at a reduced speed in the direction indicated by an arrow X in FIG. 4 together with the feed cam gear 54*a* accompanying the rotation of the arm shaft 39. When the detecting member 40 which is driven at a reduced speed by the arm shaft 39 in this way is turned by a set angle of $\alpha°$ from a reference point a illustrated in FIG. 4, i.e., the needle 37 performs a given cycles of reciprocation, the stop sensor 42 which is provided to face the locus of the tongue 40*a* detects the approach of the same and supplies a detecting signal (a speed switching signal) to the control box 43 set forth above.

Upon reception of the detecting signal produced by the stop sensor 42 and the signal produced by the needle position detector 38 (the needle-up position signal Nu, etc.), an arm shaft rotating speed control unit 53 in the control box 43 switches the control voltage of the driving motor 35 to that for low speed so as to control the rotating speed of the arm shaft 39 at low speed operation and stops the driving motor 35 when the needle 37 is at the up position after a given number of stitches that is previously set are made. In this way, the rotating speed of the arm shaft 39 which is driven by way of the belt transmission device 51 is changed.

When the foot switch 31 is stepped on as far as the first step at the start of sewing operation, the first switch SW1 is turned OFF and the work holder 33 lowers to press the sewn product 29 based on the detecting signal produced thereby.

When the foot switch 31 is further stepped on as far as the second step, the second switch is turned ON and the driving motor 35 starts low-speed rotation based on the detecting signal produced thereby. As a result, the arm shaft 39 is rotated by the driving motor 35 by way of the belt transmission device 51 so that the sewing machine starts rotation to perform sewing at low speed according to the feed pattern of the feed cam 36. When the driving motor 35 start the low speed rotation, the needle 37 is at the up (stop) position thereof. Then the needle position detector 38 produces the needle-up position signals Nu and the needle-down position signals Nd alternately and at a comparatively large time interval. Upon reception of the signal produced by the needle position detector 38, the driving motor 35 is switched to a high speed rotation and the arm shaft 39, i.e., the sewing machine is switched to a high speed operation after a given number of stitches are made.

When a cycle of sewing operation approaches its end, the tongue 40*a* which is the detecting portion of the detecting member 40 is turned onto the stop sensor 42 on the bracket 41 and produces a detecting signal (speed switching signal) by approaching and coming above the same. The arm shaft rotating speed control unit 53 in the control box 43 supplies a signal indicating a low speed rotation to the driving motor 35 based on the detecting signal so that the sewing machine is switched to the low speed operation and stops when the needle 37 is at the up position after a given number of stitches are made.

After the last stitch is made in a cycle of sewing operation, thread trimming is performed. When the last stitch is made, the tongue 40*a* of the detecting member 40 is turned onto the stop sensor 42 on the bracket 41 to be at the position which is closest to the stop sensor 42 thereabove. Thereafter the tongue 40*a* comes off the stop sensor 42, when a detecting signal ON is produced to start the thread trimming operation. Upon reception of the detecting signal ON, the thread trimming operation starts at the last stitch of a cycle of sewing operation to trim the thread by a movable knife and a stationary knife, not shown. Then the work holder 33 is raised to release the sewn product 29 from being pressed so as to complete a cycle of sewing operation and return to the original state.

A bar tacking stitch pattern A is formed by displacing the work holder 33 laterally and longitudinally relative to the needle 37 in synchronism with the vertical motion of the needle 37 using the lockstitch bar tacking sewing machine for forming such a cycle of bar tacking stitch pattern.

The feed cam 36 which makes one revolution in a cycle of sewing operation set forth above comprises a cam surface for forming the following bar tacking stitch pattern A. That is, the cam surface is formed in such a way as to form a bar tacking stitch pattern A covering the starting and ending portions of the overedge chain stitches B around the buttonhole C in the sewn product 29, the overedge chain stitches B being previously formed by a buttonhole sewing machine as illustrated in FIG. 2. The bar tacking stitch pattern A has a function to prevent the portions of the sewn product 29 which are located adjacent to the end portions of the buttonhole C in the extending direction thereof (the vertical direction in FIG. 2) and the end portions of the overedge chain stitches B from being frayed.

The bar tacking stitch pattern A comprises a uniform stitch pattern without forming stitches at the end portion of the buttonhole C which is formed at the center of the overedge chain stitches B for accepting a button therein. The bar tacking stitch pattern A which is formed in the direction substantially at right angles to the extending direction of the buttonhole C as illustrated in an enlarged view in FIG. 1 is composed of lateral stitches A1 comprising stitches denoted at 1 to 8 and a zigzag stitches A2 which extends laterally in zigzag to cross the lateral stitches A1 and comprises stitches denoted at 9 to 28, each segment of the zigzag stitches A2 extending almost vertically.

Figure 1:
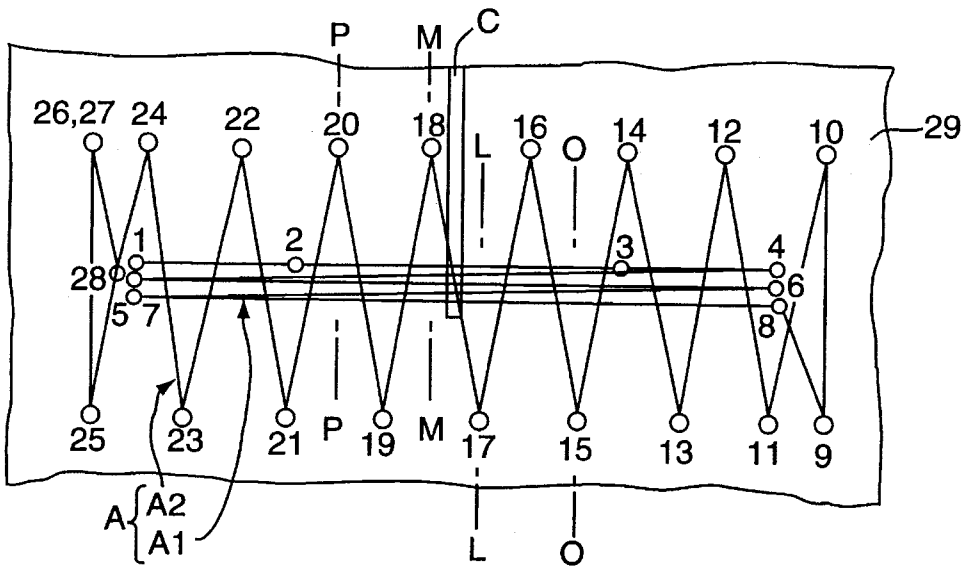
FIG. 1 is an enlarged view of a bar tacking stitch pattern according to an embodiment of the present invention.
Figure 5:
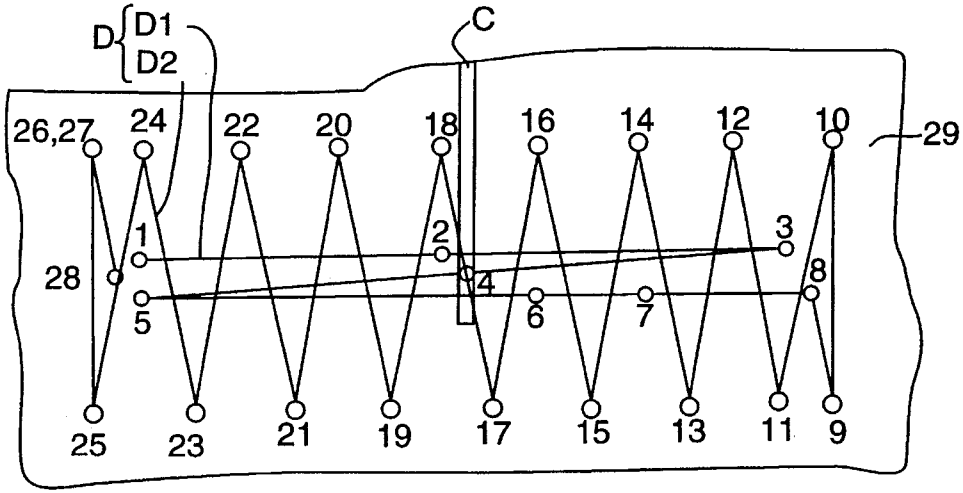
FIG. 5 is an enlarged view showing a conventional bar tacking stitch pattern.

In a lockstitch bar tacking sewing machine, 5 (or 7) lines of lateral stitches A1 are formed by displacing the work holder 33 relative to the needle 37 in the order as illustrated in FIG. 1 based on the variation of cam surface of the feed cam 36 which is rotated in synchronism with the vertical motion of the needle 37, while the work holder 33 equipped with the clamp feet and the feed plate holds the sewn product 29 therebetween. The lateral stitches A1 extend laterally with sharp turns at the junctions thereof to form a stitches. The lateral stitches A1 should not be formed about the central portions of the overedge chain stitches B. Then zigzag stitches A2, each section of which extends almost vertically, are formed from right to left over the 5 (or 7) lines of lateral stitches A1 guided thereby to complete the bar tacking stitch pattern A.

The center of the bar tacking stitch pattern A is at the slit of the buttonhole C and either of the stitches 1 to 8 of the lateral stitches A1 should not be formed about the center of the zigzag stitches A2.

In the embodiment illustrated in the figure, the stitches 2 and 3 of the lateral stitches A1 are deliberately prevented from being formed between the stitches 15 and 20 of the zigzag stitches A2, i.e., between the line segments O—O and P—P which respectively extend through the stitches 15 and 20 of the zigzag stitches A2 in the extending direction of the buttonhole C (vertical direction in FIG. 2), but it is enough to at least prevent the formation of the stitches 2 and 3 of the lateral stitches A1 between the stitches 17 and 18 of the zigzag stitches A2 which are located at the central portion thereof, i.e., between the line segments L—L and M— M which respectively extend through the stitches 17 and 18 of the zigzag stitches A2 in the extending direction of the buttonhole C. The pair of stitches 17 and 18 of the zigzag stitches A2 are formed on both sides of the end portion of the buttonhole C adjacent thereto in such a way as to be symmetrical with regard to the buttonhole C.

In this way, the formation of the stitches 1 to 8 of the lateral stitches A1 of the bar tacking stitch pattern A is deliberately prevented from being formed between the line segments L—L and M—M which respectively extend through the stitches 17 and 18 of the zigzag stitches A2 in the extending direction of the buttonhole C, the stitches 17 and 18 being located on both sides of the end portion of the buttonhole C surrounded by the overedge chain stitches B. A cycle of sewing operation forms 28 stitches in this embodiment, it is the same in case of other number of stitches.

Since the stitches 1 to 8 of the lateral stitches A1 are not formed adjacent to the center of the overedge chain stitches B in such a buttonhole sewing for forming the overedge chain stitches B and the bar tacking stitch pattern A, the stitches 1 to 8 are not formed in the portions adjacent to the buttonhole C of the sewn product 29 which is in a weak condition. As a result, it is effectively prevented that the sewn product 29 is laterally drawn due to the stitches 1 to 8 of the lateral stitches A1 and consequently generate ugly shrinkages about the buttonhole C thereof. Since the 5 (or 7) lines of lateral stitches A1 are larger in number than the conventional 3 lines, the lack of strength due to the lack of the stitches 1 to 8 adjacent to the center of the overedge chain stitches B is prevented. Moreover, the zigzag stitches A2 each segment of which extends almost vertically is formed over the lateral stitches A1 guided thereby, the lateral stitches A1 are pressed clown by the zigzag stitches A2. Accordingly, the lateral stitches A1 is prevented from floating to deteriorate the quality of the sewn product in spite of the omission of the stitches 1 to 8 of the lateral stitches A1 adjacent to the buttonhole C.

Although a given bar tacking stitch pattern A is formed by displacing the work holder 33 laterally and longitudinally relative to the needle 37 by the variation of cam surface of the feed cam 36 which is rotated in synchronism with the vertical movement of the needle 37 according to the embodiment set forth above, the present invention is similarly applicable to an embodiment wherein the work holder 33 is displaced relative to the needle 37 in the same order based on electric control in the X (vertical) and Y (horizontal) directions without employing the feed cam 36.

As understood from the above description, the bar tacking stitch pattern according to the present invention can has the following effect.

The bar tacking stitch pattern formed over the starting and ending portions of overedge chain stitches around a buttonhole in buttonhole sewing does not contain lateral stitches in the portion of a sewn product adjacent to the buttonhole which is in a weak condition. As a result, it is possible to form a decent bar tacking stitch pattern at an end portion of the buttonhole and consequently form a stable and uniform stitch pattern without generating a shrinkage in the sewn product so as to improve the quality thereof.

What is claimed is:

1. In combination:

a buttonhole having an enlarged end, an opposite narrow end and an elongated narrow opening connecting the two ends, the buttonhole having small overedge chain stitches which are disposed end to end and extend continuously from a starting side of the narrow end along one side of the narrow opening and the enlarged end and along the other side of the narrow opening to the opposite ending side of the narrow end; and a bar tacking stitch pattern covering the starting and ending sides of the narrow end and extending therebetween, said pattern including lines of lateral stitches which extend at right angles to the direction of the narrow opening and zig-zag stitches which cover the area defined by the lateral stitches and extend from the starting to the ending sides of the narrow end, the lines of lateral stitches extending through the zig-zag stitches.

* * * * *